United States Patent [19]

Hammond et al.

[11] 4,141,257

[45] Feb. 27, 1979

[54] SAFETY LATCH FOR TRACTOR LOADER

[75] Inventors: Howard A. Hammond, Alexander; John F. Sardina, Williamsville, both of N.Y.

[73] Assignee: Eaton Corporation, Cleveland, Ohio

[21] Appl. No.: 829,118

[22] Filed: Aug. 30, 1977

[51] Int. Cl.[2] ..... G05G 5/06; B66F 9/00; E02F 3/00

[52] U.S. Cl. ..... 74/529; 214/776

[58] Field of Search ..... 214/776, 769; 74/529; 298/17 B; 172/466, 481

[56] References Cited

U.S. PATENT DOCUMENTS 3,360,146 12/1967 Borer et al. ..... 214/776

3,396,863 8/1968 Borer et al. ..... 214/776

*Primary Examiner*—Leonard H. Gerin

*Attorney, Agent, or Firm*—D. Wood

[57] ABSTRACT

A safety latch mechanism for use with a tractor loader of the type including a pair of bucket supporting lift arms rigidly interconnected by a cross member. The latch mechanism includes a link pivoted at one end to the forward end of the loader frame and including a pin at its free end which coacts with a notch defined on the cross member to latchingly secure the cross member to the frame in response to upward movement of the lift arms about their pivot axis. The lift arm assembly is thus rigidly latched in a raised position to allow shop or field maintenance.

15 Claims, 4 Drawing Figures

SAFETY LATCH FOR TRACTOR LOADER

BACKGROUND OF THE INVENTION

This invention relates to tractor loaders. More particularly, it relates to a safety latch mechanism for a tractor loader.

To facilitate repair or replacement work at the front end of a tractor loader, e.g., repair or replacement of the bucket or repair or replacement of the lift cylinders, it is necessary to raise the lift arm assembly and hold it in a raised position. The people performing the repair or replacement work, either in the shop or in the field, are endangered by the mass of the lift arm assembly suspended above them; accordingly, it is desirable to latch or lock the lift arm assembly in a raised position so that it is positively held in that position rather than relying solely on the pressure in the hydraulic circuit supplying the lift cylinders.

Various latch mechanisms have heretofore been proposed and/or utilized to provide this positive latching feature. However, the various prior art mechanisms have required delicate and precise positioning operations to achieve the safety latched configuration and/or have failed in their safety latched configuration to provide positive preclusion of both upward and downward movement of the lift arm assembly.

SUMMARY OF THE INVENTION

Accordingly, it is an object of the present invention to provide a safety latch mechanism for a tractor loader which demands minimal dexterity on the part of the operator to achieve the latched configuration and which, in the latched configuration, positively precludes both upward and downward movement of the lift arm assembly.

According to an important feature of the present invention, coacting latch means are carried by the lift arm assembly and by the loader frame, respectively, and the coacting latch means include a latching member which is moveable between a first position in which the lift arm assembly is free to move about its pivot axis under the urging of the lift cylinders and a second position in which the lift arm assembly is latchingly secured to the loader frame in response to upward pivotal movement of the lift arm assembly.

According to another feature of the invention, the coacting latch means include a catch mechanism defined on a portion of the lift arm assembly and the latching member comprises a link pivotally mounted at one end on the loader frame and pivotally moveable between a stowed position in which it is clear of the trace described by the lift arm assembly portion defining the catch mechanism, and an operative position in which it intersects this trace and latchingly coacts with the catch mechanism in response to upward pivotal movement of the lift arm assembly.

In the disclosed embodiment of the invention, and according to a further feature of the invention, the lift arm assembly includes a cross member rigidly interconnecting the lift arms at a location intermediate their ends, the catch mechanism is defined on this cross member, and the latching link includes a cross pin adjacent its free end which latchingly coacts with a generally upwardly opening notch defined by the catch mechanism. With the latching link in its operative position, as the lift arm assembly is raised, a guide surface on the catch mechanism, disposed forwardly of the notch, picks up the cross pin on the latching link and, in response to continued upward movement of the lift arm assembly, cammingly walks the pin rearwardly therealong and into the notch.

According to another feature of the invention, the forward portion of the notch is undercut to an extent to allow the pin to walk forwardly into the forward notch portion in response to slight lowering movement of the lift arm assembly following deposit of the pin into the notch. The link, lift arms and loader frame thereby form a rigid triangulated structure precluding further lowering movement of the lift arm assembly.

According to yet another feature of the invention, the rearward portion of the latching notch is also undercut so that, with the pin seated in the forward notch portion, inadvertent upward movement of the lift arm assembly is limited to the incremental amount permitted as the pin walks rearwardly in the notch from the forward notch portion into the rearward notch portion. With the pin seated in the rearward notch portion, further upward movement of the lift arm assembly is positively precluded.

Further objects, features and advantages of the invention will be apparent from the drawings and from the description of the preferred embodiment.

BRIEF DESCRIPTION OF THE DRAWINGS

FIG. 3 is a view similar to FIG. 2 but with the bucket partially raised; and

DESCRIPTION OF THE PREFERRED EMBODIMENT

Figure 1:
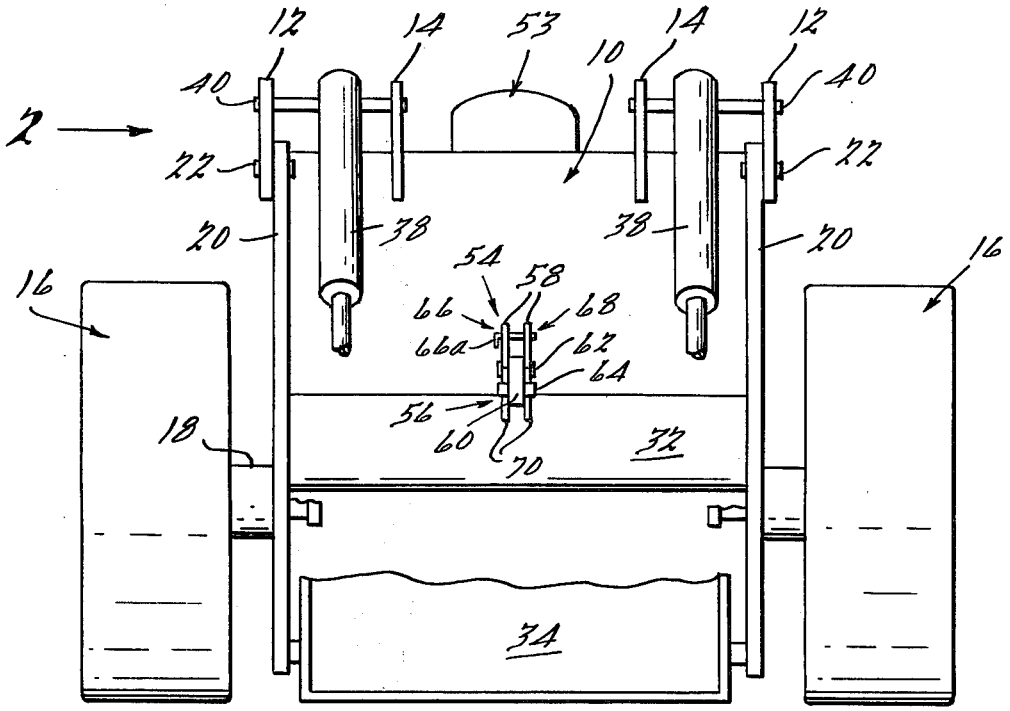
FIG. 1 is a partially fragmentary front view of a tractor loader with the bucket in its lowered position and with portions of the bucket and the bucket tilt mechanism broken away to reveal details of the invention safety latch.

The tractor loader shown fragmentarily in the drawings includes a tractor frame shown generally at 10 and including a pair of frame weldment uprights 12 positioned adjacent the respective outboard edges of the frame and further weldment uprights 14 (FIG. 1) positioned inboard of uprights 12; front wheel assemblies 16 carried by a rigid axle 18; lift arms 20 pivoted at their rearward ends at 22 to frame uprights 12; lift cylinders 24 pivoted at their lower ends to the frame at 26 and pivoted at their upper ends at 28 to pads 30 welded to lift arms 20; a hollow cross member 32 rigidly interconnecting the lift arms; a bucket 34 pivotally secured at 36 to the forward ends of the lift arms; tilt cylinders 38 pivoted at their rearward ends at 40, between weldments 12, 14; tilt levers 42 pivoted at their lower ends at 44 to lift arms 20 and pivotally secured intermediate their ends at 46 to the forward ends of tilt cylinders 38; and tilt links 48 pivotally secured at their rearward ends at 50 to the upper ends of tilt levers 42 and at their forward ends at 52 to bucket 34. The loader is controlled by an operator positioned in a seat 53 (FIG. 1). The loader construction thus far described is known.

The invention safety latch mechanism includes coacting latch means 54, 56 carried respectively by the forward end 10*a* of the tractor frame and by cross member 32.

Specifically, the latch means 54 carried by the front end 10*a* of the tractor frame includes a pair of brackets 58 welded to the angled upper face 10*b* of frame front end 10*a* in laterally spaced relation and symetrical with the vehicle center line; a latching member in the form of a link 60 disposed between brackets 58 and pivoted at one end by pin 62 to the forward ends of the brackets; a cross latching pin 64 carried adjacent the free end of latching link 60; and a retainer pin 66 adapted to pass through aligned holes in brackets 58 and latching link 60 to secure the link. Retainer pin 66 has a cranked end portion 66*a* defining a handle to facilitate insertion and removal, and a cotter pin 68 is provided at the other end of pin 66 to preclude inadvertent removal.

The latch means 56 carried by cross member 32, broadly considered, defines a catch mechanism for coaction with latch pin 64. Specifically, latch means 56 includes a pair of brackets 70 welded to cross member 32 in laterally spaced relation. Brackets 70 are symetrical with the vehicle center line and are longitudinally aligned with brackets 58. Each bracket 70 includes a leading or guide surface 70*a*, a notch 70*b*, and a trailing surface 70*c*. Each notch 70*b* includes a forward portion 70*d* which is undercut with respect to guide surface 70*a* and a rearward portion 70*e* which is undercut with respect to trailing surface 70*c*.

In normal operation of the tractor loader, the link 60 is maintained in its stowed position by retainer pin 66; in this position, link 60 is clear of the trace of cross member 32 so as not to interfere with the normal upward and downward pivotal movement of the lift arm assembly.

Figure 2:
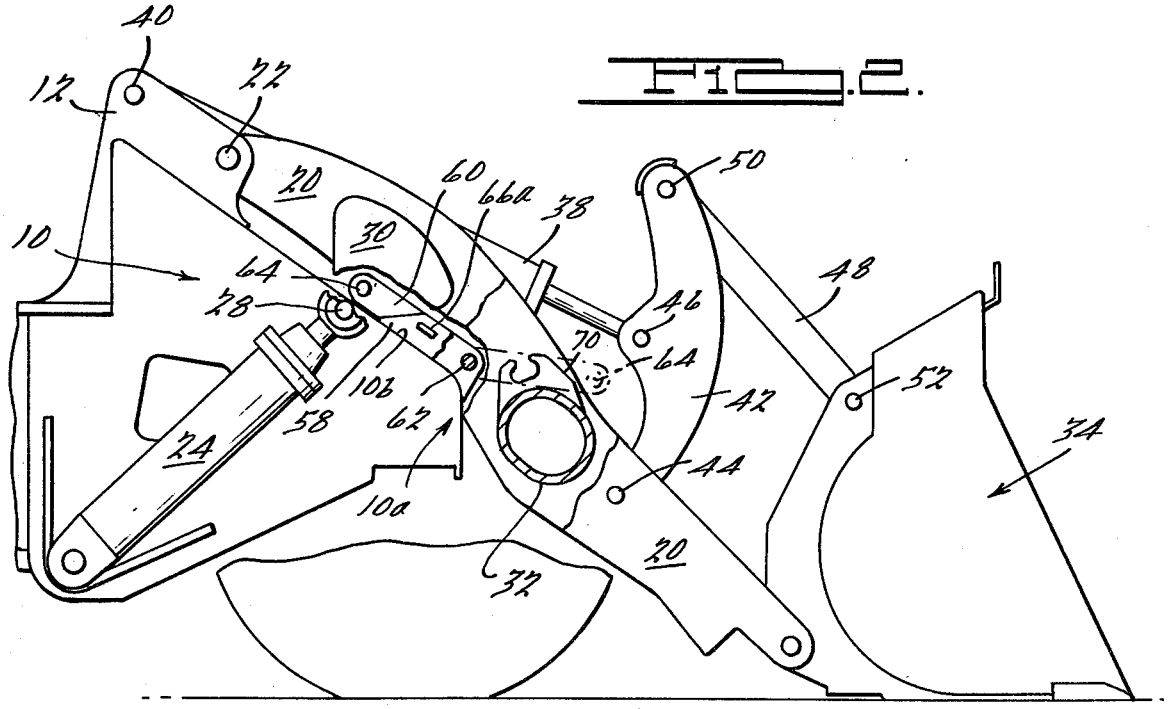
FIG. 2 is a side elevational view looking in the direction of the arrow 2 in FIG. 1 and with a portion of the near lift arm broken away to reveal details of the invention safety latch.
Figure 5:
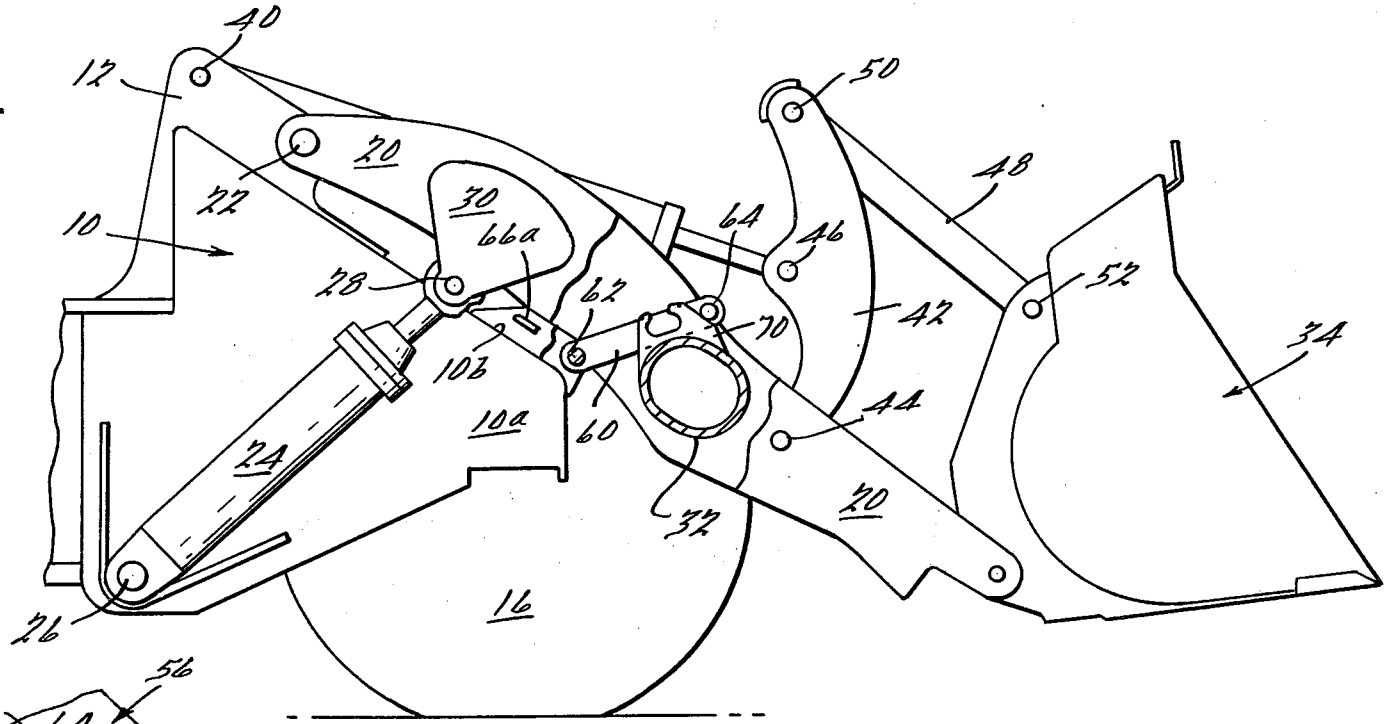
Figure 4:
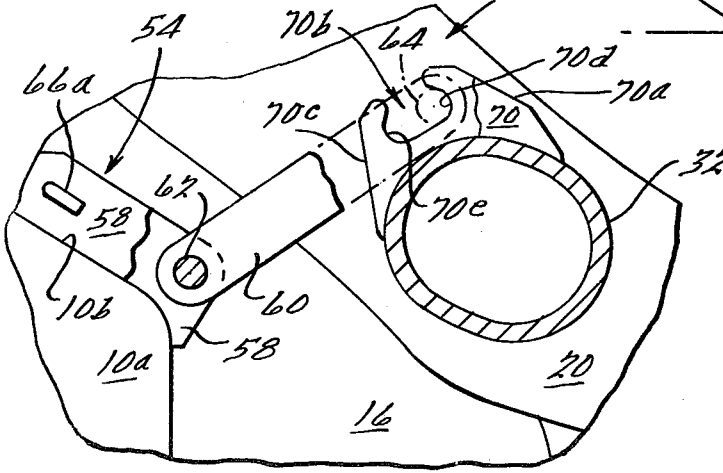
FIG. 4 is a fragmentary view of the invention safety latch showing the latch in its positively latched configuration.

When a need arises to perform service work, either shop or field, on the front end of the loader, the operator, after moving the lift arm assembly to the lowered position of FIG. 2, removes retainer pin 66 and pivots link 60 forwardly to its operative position (shown in phantom in FIG. 2) in which it is cradled between brackets 70 and rests on the upper surface of cross member 32 with latch pin 64 disposed clear of, and generally forwardly of, guide surfaces 70*a*. The operator then actuates lift cylinders 24 to raise the lift arm assembly. As the lift arm assembly pivots upwardly about pivot axis 22, guide surfaces 70*a* on brackets 70 pick up latch pin 64 (FIG. 3) and, upon continued upward pivotal movement, cammingly walk pin 64 rearwardly therealong until the pin drops into notches 70*b*. At this point, the operator stops the upward movement of the lift arm assembly and reverse actuates lift cylinders 24 to lower the lift arm assembly slightly and allow pin 64 to walk generally forwardly into undercut notch portions 70*d*, whereupon the lift cylinders may be deactuated since the weight of the lift arm assembly is now supported by a rigid triangulated structure formed by link 60, lift arms 20, and loader frame 10. The fully seated position of pin 64 is shown in FIG. 4. In this position, the lift arms are precluded from downward movement by the seating engagement of pin 64 in forward notch portions 70*d* and upward movement of the lift arms, in response, for example, to inadvertent actuation of the lift cylinders, is limited to the incremental amount permitted as pin 64 walks rearwardly in notches 70*b* from forward notch portions 70*d* to rearward notch portions 70*e*.

Following completion of the required service work, lift cylinders 24 may be actuated to raise the lift arm assembly slightly and walk pin 64 rearwardly out of undercut notch portions 70*d*, whereupon the operator may swing link 60 rearwardly to its stowed position and secure it in that position by insertion of retainer pin 66.

It will be seen that the disclosed safety latch requires a minimum of operator dexterity to achieve the safety latched configuration, or to disengage from that configuration, and, when in the safety latched configuration, provides positive preclusion of both upward and downward movement of the lift arm assembly.

Whereas a preferred embodiment of the invention has been shown and described in detail, it will be apparent to those skilled in the art that various modifications of the preferred embodiment may be made without departing from the scope or spirit of the invention as defined in the appended claims. For example, although the safety latch, as disclosed, requires the vehicle operator to leave his seat in order to move link 60 between its stowed and operative positions, it will be apparent that a cable or other remote actuator could be provided to allow the operator to move the link between its stowed and operative positions without leaving the operator's seat.

We claim:

1. A safety latch mechanism for use with a tractor loader of the type including a loader frame; a lift arm assembly including a pair of lift arms pivotally mounted adjacent their rearward ends to opposite sides of said frame; a pair of lift cylinders for pivoting said lift arm assembly; and a bucket pivotally mounted to the forward ends of said lift arms; said safety mechanism including:

A. coacting latch means carried by said lift arm assembly and said frame, respectively, and including a latching member moveable between a first position in which said lift arm assembly is free to move about its pivot axis under the urging of said lift cylinders and a second position in which said lift arm assembly is latchingly secured to said frame in response to upward movement of said lift arm assembly about said pivot axis.

2. A safety latch mechanism according to claim 1 wherein

B. said coacting latch means further include a catch mechanism defined on a portion of said lift arm assembly and C. said latching member comprises a link pivotally mounted at one end on said frame and pivotally moveable between a. a stowed position in which it is clear of the trace described by said lift arm assembly portion and b. an operative position in which it intersects said trace and latchingly coacts with said catch mechanism in response to upward movement of said lift arm assembly about said pivot axis.

3. A safety latch mechanism according to claim 2 wherein

D. a cross pin is provided at the free end of said link; and

E. said catch mechanism includes means defining a generally upwardly opening notch in which said cross pin is received in response to upward pivotal movement of said lift arm assembly.

4. A safety latch mechanism according to claim 3 wherein

F. the pivot axis of said link is substantially forward of the pivot axis of said lift arms; and G. said catch mechanism defines a guide surface, disposed forwardly of said notch, operative, upon upward pivotal movement of said lift arm assembly with said link in its operative position, to pick up said cross pin and, in response to continued upward pivotal movement of said lift arms, cammingly walk said pin rearwardly therealong and into said notch.

5. A safety latch mechanism according to claim 4 wherein

H. the forward portion of said notch is undercut to an extent to allow said pin to walk forwardly into said forward notch portion in response to slight lowering movement of said lift arm assembly following deposit of said pin into said notch, the link, lift arms and loader frame thereby forming a rigid triangulated structure precluding further lowering movement of said lift arm assembly.

6. A safety latch mechanism according to claim 5 wherein

I. the rearward portion of said notch is also undercut so that, with said pin in said forward notch position, inadvertent upward pivotal movement of said lift arm assembly is limited to the incremental amount permitted as said pin walks rearwardly in said notch from said forward notch portion into said rearward notch portion.

7. A safety latch mechanism according to claim 6 wherein

J. said link, in its stowed position, extends generally rearwardly in juxtaposition to said adjacent frame portion, and K. said link, in its operative position, and with the lift arm assembly in its lowered position, lays on, and is supported by, the adjacent upper surface of said cross member.

8. A safety latch mechanism according to claim 1 wherein

B. said lift arm assembly includes a cross member rigidly interconnecting said lift arms at a location intermediate their ends, and C. said coacting latch means are carried by said cross member and by a portion of said frame adjacent the trace described by said cross member upon pivotal movement of said lift arm assembly.

9. A safety latch mechanism according to claim 8 wherein

D. said cross member is arranged to clear the forward end of said loader frame as the bucket is moved to its lowered position;

E. said adjacent frame portion is defined on the forward end of said loader frame;

F. said latching member comprises a link pivotally mounted at one end to said adjacent frame portion and pivotally moveable between a. a stowed position in which it is clear of the trace of said cross member and b. an operative position in which it extends forwardly from said frame portion and intersects said trace; and G. the coacting latch means carried by said lift arm assembly comprises a catch mechanism defined on said cross member and arranged to latchingly receive the free end of said link, with the link in its operative position, in response to upward pivotal movement of the lift arm assembly.

10. A safety latch mechanism according to claim 9 wherein

H. a cross pin is provided at the free end of said link; and

I. said catch mechanism includes means defining a generally upwardly opening notch in which said cross pin is received in response to upward pivotal movement of said lift arm assembly.

11. A safety latch mechanism according to claim 10 wherein

J. the pivot axis of said link is substantially forward of the pivot axis of said lift arms; and K. said catch mechanism defines a guide surface, disposed forwardly of said notch, operative, upon upward pivotal movement of said lift arm assembly with said link in its operative position, to pick up said cross pin and, in response to continued upward pivotal movement of said lift arms, cammingly walk said pin rearwardly therealong and into said notch.

12. A safety latch mechanism according to claim 11 wherein

L. the forward portion of said notch is undercut to an extent to allow said pin to walk forwardly into said forward notch portion in response to slight lowering movement of said lift arm assembly following deposit of said pin into said notch, the link, lift arms and loader frame thereby forming a rigid triangulated structure precluding further lowering movement of said lift arm assembly.

13. A safety latch mechanism according to claim 12 wherein

M. the rearward portion of said notch is also undercut so that, with said pin in said forward notch position, inadvertent upward movement of said lift arm assembly is limited to the incremental amount permitted as said pin walks rearwardly in said notch from said forward notch portion into said rearward notch portion.

14. A safety latch mechanism according to claim 13 wherein

N. said link, in its stowed position, extends generally rearwardly in juxtaposition to said adjacent frame portion, and O. said link, in its operative position, and with the lift arm assembly in its lowered position, lays on, and is supported by the adjacent upper surface of, said cross member.

15. A safety latch mechanism for use with a tractor loader of the type including a loader frame, a pair of lift arms pivotally mounted adjacent their rearward ends to opposite sides of said frame, a bucket pivotally mounted to the forward ends of said lift arms, and a cross member rigidly interconnecting said lift arms at a location intermediate their ends, said safety mechanism including:

A. a link pivotally mounted at one end to said frame at a location thereon adjacent said cross member and pivotally moveable between a. a stowed position in which it is clear of the trace of said cross member and b. an operative position in which it intersects the trace of said cross member, and B. coacting latch means on said cross member and on the free end of said link, respectively, operative in response to upward pivotal movement of said cross member along its trace, with said link in its operative position, to latchingly secure said cross member, in a raised position, to said frame.

* * * * *